US006072381A

United States Patent [19]

Yu

[11] Patent Number: 6,072,381

[45] Date of Patent: Jun. 6, 2000

[54] SMALL-SIZED SIMPLE SWITCH FOR PROTECTING CIRCUIT

[76] Inventor: Tsung-Mou Yu, No. 4, Alley 2, Lane 23, Sec. 13, Pa-Te Road, Pan-Chiao City, Taipei Hsien, Taiwan

[21] Appl. No.: 09/304,780

[22] Filed: May 4, 1999

[30] Foreign Application Priority Data

Feb. 12, 1999 [TW] Taiwan ..... 88202642

[51] Int. Cl.[7] ..... H01H 37/02; H01H 37/32; H01H 37/46; H01H 37/52

[52] U.S. Cl. ..... 337/37; 337/333; 337/39; 337/59; 337/85; 337/112; 337/113

[58] Field of Search ..... 337/312, 333, 337/37, 39, 59, 85, 337, 1, 3, 12, 14, 16, 62, 66, 68, 72, 75, 79, 89, 101, 111–113; 200/553–557; 29/622

[56] References Cited

U.S. PATENT DOCUMENTS

| | | | |
|---|---|---|---|
| 2,563,175 | 8/1951 | Kitman | 337/66 |
| 4,337,450 | 6/1982 | Matthies | 337/66 |
| 5,262,748 | 11/1993 | Tsung-Mou | 337/66 |
| 5,498,846 | 3/1996 | Chin | 200/557 |
| 5,539,371 | 7/1996 | Yu | 337/66 |
| 5,694,106 | 12/1997 | Wang | 337/79 |
| 5,760,672 | 8/1951 | Wang | 337/79 |
| 5,828,284 | 10/1998 | Huang | 337/37 |
| 5,847,638 | 12/1998 | Sorenson | 337/380 |
| 5,892,426 | 4/1999 | Huang | 337/59 |

FOREIGN PATENT DOCUMENTS

| | | | |
|---|---|---|---|
| 82204642 | 6/1993 | Romania . | |
| WO 94/17745 | 8/1994 | WIPO | H01H 71/52 |

*Primary Examiner*—Leo P. Picard
*Assistant Examiner*—Anatoly Vortman
*Attorney, Agent, or Firm*—Wood, Herron & Evans, L.L.P.

[57] ABSTRACT

A small-sized simple switch for circuit protection of the present invention is simple in structure and easy to operate, and can be readily switched for safety protection of circuits. An alloy plate of the present invention is highly resilient. When in overload, the alloy plate expands and becomes deformed due to the different thermal expansion coefficient and is deformed upward to become disengaged from a wire connecting pad with which it is originally in contact, causing the switch to be switched from the "ON" condition to the "OFF" condition. The alloy plate pushes a lever pivoted to the moving end of the alloy plate to move up such that the lever pushes one end of a pivoted reset button to move up. A user only has to depress the reset button and the switch will be again in the "ON" condition such that repeated ON/OFF conditions of the protection circuit can be effected. If there is no overload on the circuit, the switch of the present invention will be operated to be in "ON" or "OFF" condition as ordinary switches.

3 Claims, 7 Drawing Sheets

SMALL-SIZED SIMPLE SWITCH FOR PROTECTING CIRCUIT

BACKGROUND OF THE INVENTION

1. Field of the Invention

The small-sized simple switch for protecting circuit of the present invention relates to a circuit protection device which is simple in structure and used to control ON/OFF of a circuit and, in particular, to a switch which automatically trips for circuit protection during power overload and which resets the circuit to the original "ON" condition only after the user depresses a reset button on the switch.

2. Description of Related Art

Conventional switches for indoor use or for use on electrical appliances are of the pressing type which effect switching between the closing and opening of a circuit by depressing a switch's ON/OFF button. However, these switches only serve the function of switching between the closing and the opening of a circuit and can not ensure safety for power supply for these switches do not automatically trip or cut off the power supply for circuit protection when a power overload exists.

In U.S. Pat. No. 5,262,748 issued on Nov. 16, 1993 (see FIG. 1), a switch for circuit protection is disclosed in which an n-shaped spring plate 11 springs up when the power is overload and then an alloy plate 13 is moved up by an actuating lever 12, causing contacting points 14, 15 to become disengaged. With this switch, in addition to requiring the n-shaped spring plate 11, another support lever 17 is connected under the center of a pressing portion 16 and a round head 171 of the support lever is embedded in a braking slot 18 so as to control the swing of the support lever 17 back and forth such that both the structure and the operation of the switch are rather complicated. In RON application Pat. No. 82,204,642 published on Jun. 21, 1993 (see FIG. 2), another switch for circuit protection is disclosed in which an arcuated resilient plate 21 is pivoted to a contact spring plate 22 and abuts against an actuating plate 24 when the platinum contacting point 221 of the contact spring plate 22 is in contact with the platinum contacting point 231 of an wire connecting pad 23. The structure of this switch is also complicated. In U.S. Pat. No. 5,760,672 issued on Jun. 2, 1998 (see FIG. 3*a*), a further switch for circuit protection is disclosed in which no n-shaped spring plate, or arcuated resilient plate is used as disclosed in the previous patents, but an upper supporting lever 32 and a lower supporting lever 33 are provided at a proper distance above and under the arc changing position, respectively, on the disk-shaped bimetal alloy plate 31 in the switch body functioning as a seesaw, which, together with a lever 34 having a tripping space, cause the disk-shaped bimetal alloy plate 31 functioning to trip in both directions, thus effects the closing and opening of the circuit by pushing or pulling actions. Moreover, the alloy plate used in this patent is a relatively complicated disk-shaped bimetal alloy plate 31. As shown in FIG. 3*b*, the disk-shaped bimetal alloy plate 31 is structured with its central face extending from a free end to a fixing end into a contact spring plate 311, the contact spring plate 311 being provided on the extremity with a platinum contacting point 3111 for contact with the platinum contacting point 312. Then, the disk-shaped bi-metal alloy plate 31 is formed into the configuration with a wider free end and a narrower fixing end (W1>W2). As a result, when the fixing end of the disk-shaped metal alloy plate 31 is reduced to a smaller width (W2), the internal stress causes it to deform into an arcuated dish-like shape, and then, in combination with the upper and lower supporting levers 32, 33, it is possible to effect tripping for circuit protection power current overload. U.S. Pat. No. 5,828,284 issued on Oct. 27, 1998 (see FIG. 4) discloses another safety switch for overload protection. It can be seen from FIG. 4 that a resilient member 41 (a spring) engaging a driving member 42 is used in the switch, the driving member 42 being connected to a pressing portion 43 above and to a lead plate 44 below, such that when the lead plate 44 is overheated and becomes deformed, the pressing portion is pushed up, causing the switch to open for circuit protection. This switch, however, is also rather complicated in that a resilient member and the like are used.

From the foregoing, it can be seen that conventional circuit protection switches are all implemented by using a complicated structure which increases the cost.

SUMMARY OF THE INVENTION

The object of the present invention is to provide a small-sized simple switch for circuit protection which is simple in structure, easy to operate and inexpensive to manufacture. During normal operation, the switch of the present invention serves to control the closing and opening of a circuit just as a typical switch does. During the power overload, the switch trips to break the circuit for safety protection of the circuit, and the switch can be reset to normal operation by only depressing a reset button and the circuit will remain closed such that the switch of the present invention can be widely used in various electrical appliances to ensure safe power use. To achieve the above object, the on-off switch of the present invention comprises a body having a reset button, the body being provided on the lower end with at least two embedded wire connecting pads, a first wire connecting pad being provided with a silver contacting point; a lever with one end pivoted to one end of the reset button to be pushed or pulled in cooperation with the reset button; a second wire connecting pad, the upper portion thereof being secured to an alloy plate, the other end of the alloy plate being pivoted to the lever and having a silver contacting point; during the power overload, the alloy plate originally in contact with the first wire connecting pad expands and becomes deformed, causing the lever to be pushed up, and the silver contacting point on the first wire connecting pad and the silver contacting point on the alloy plate which are in contact with each other to become disengaged, thus breaking the current for circuit protection.

DESCRIPTION OF THE PREFERABLE EMBODIMENTS

Figure 1:
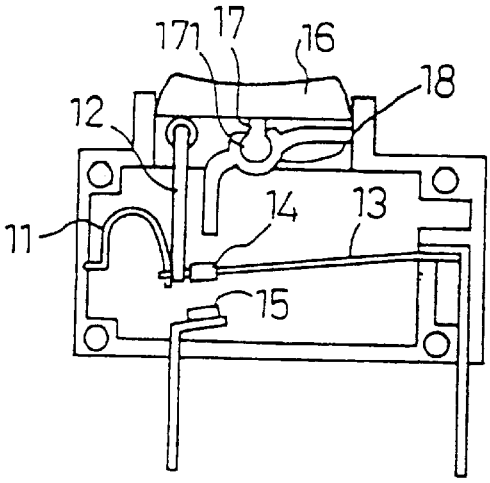
Fig. 1 (PRIOR ART)
FIG. 1 is a side view showing the structure of a conventional switch for circuit protection.
Figure 2:
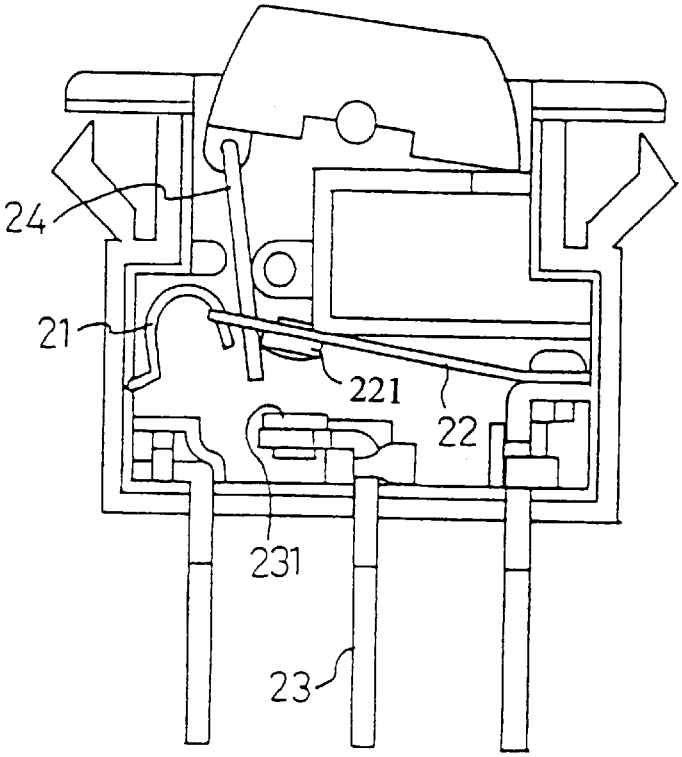
Fig. 2 (PRIOR ART)
FIG. 2 is a side view showing the structure of another conventional switch for circuit protection.
Figure 3A:
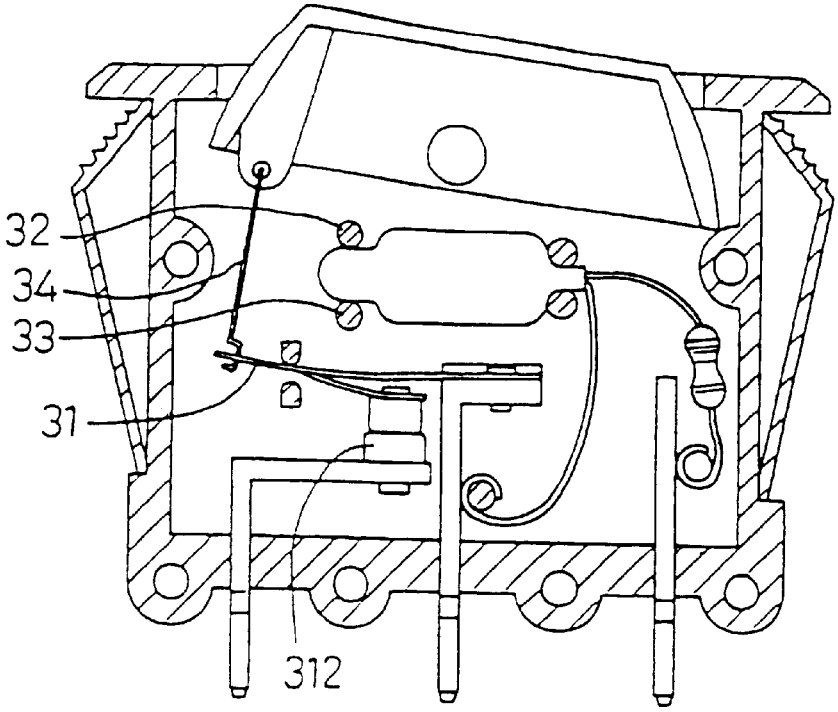
Fig. 3a (PRIOR ART)
FIG. 3*a* is a side view showing the structure of still another conventional switch for circuit protection.
Figure 3B:
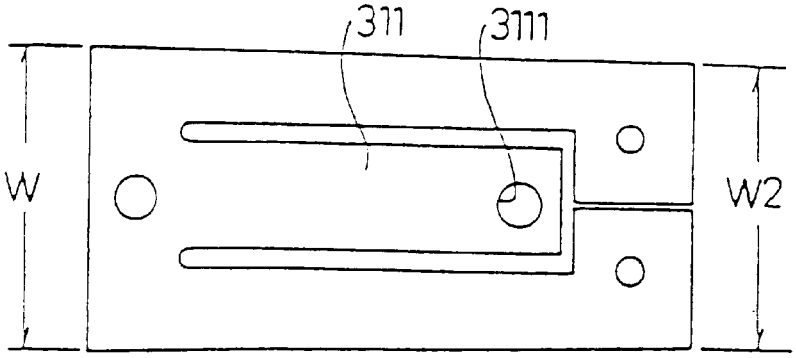
Fig. 3b (PRIOR ART)
FIG. 3*b* is a side view showing the structure of the alloy plate used in the switch shown in FIG. 3*a*.
Figure 4:
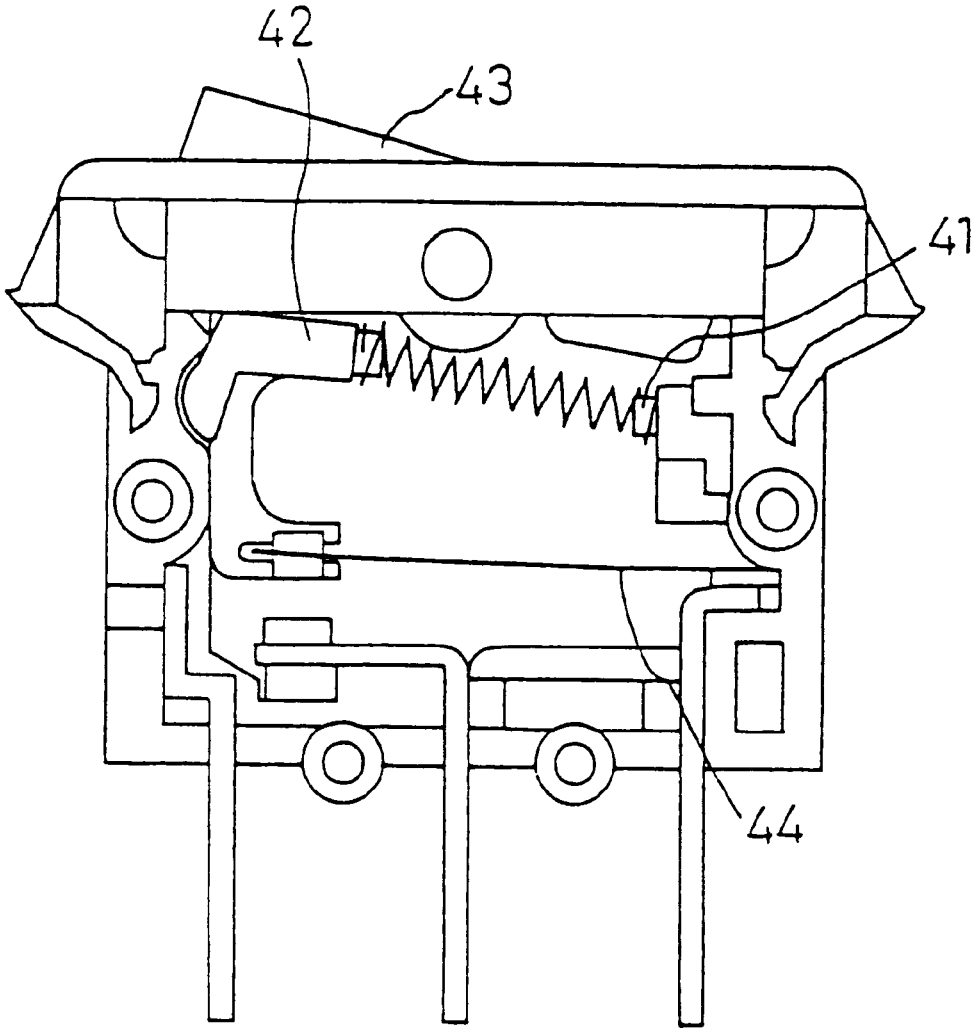
Fig. 4 (PRIOR ART)
FIG. 4 is a side view showing the structure of a still further conventional switch for circuit protection.
Figure 5A:
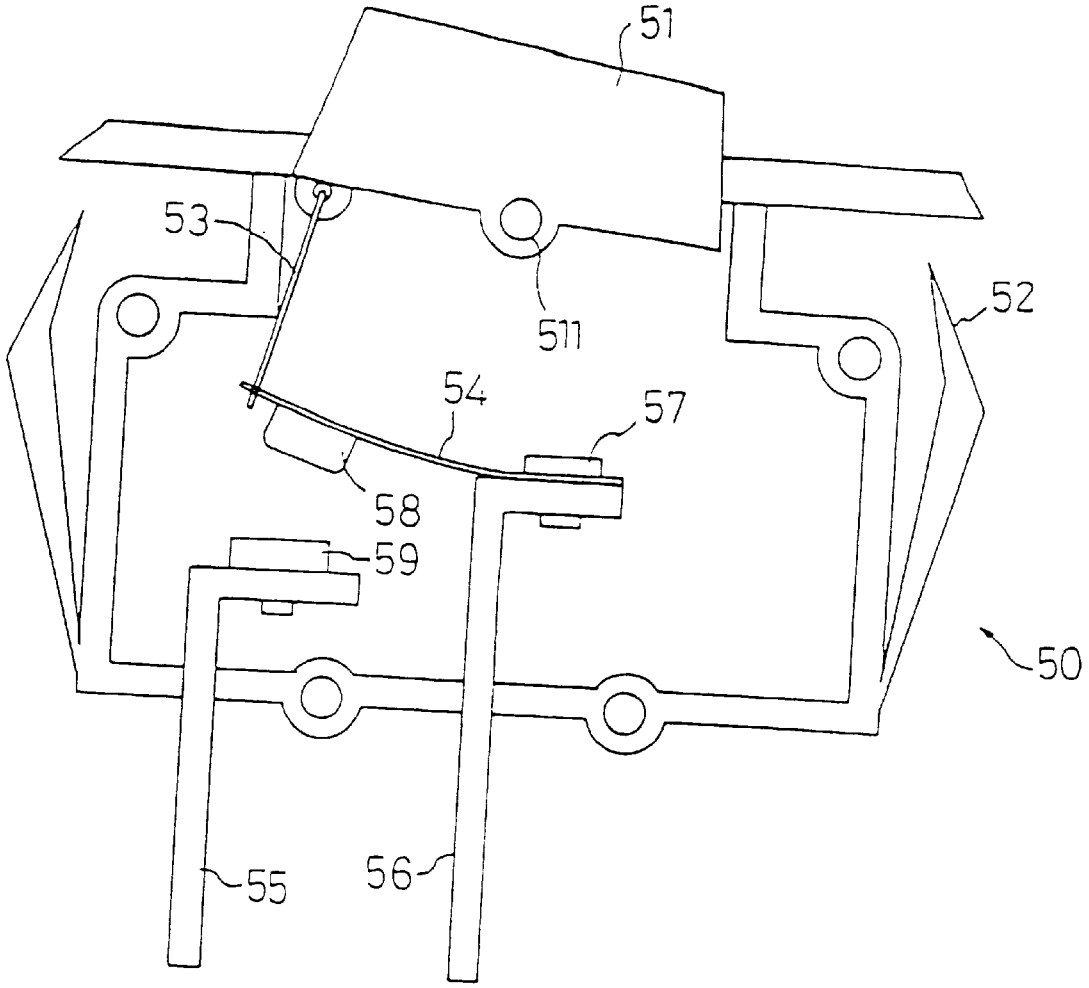
FIG. 5*a* is a side view showing the structure of a small-sized simple switch for circuit protection of the present invention in the "OFF" condition.
Figure 5B:
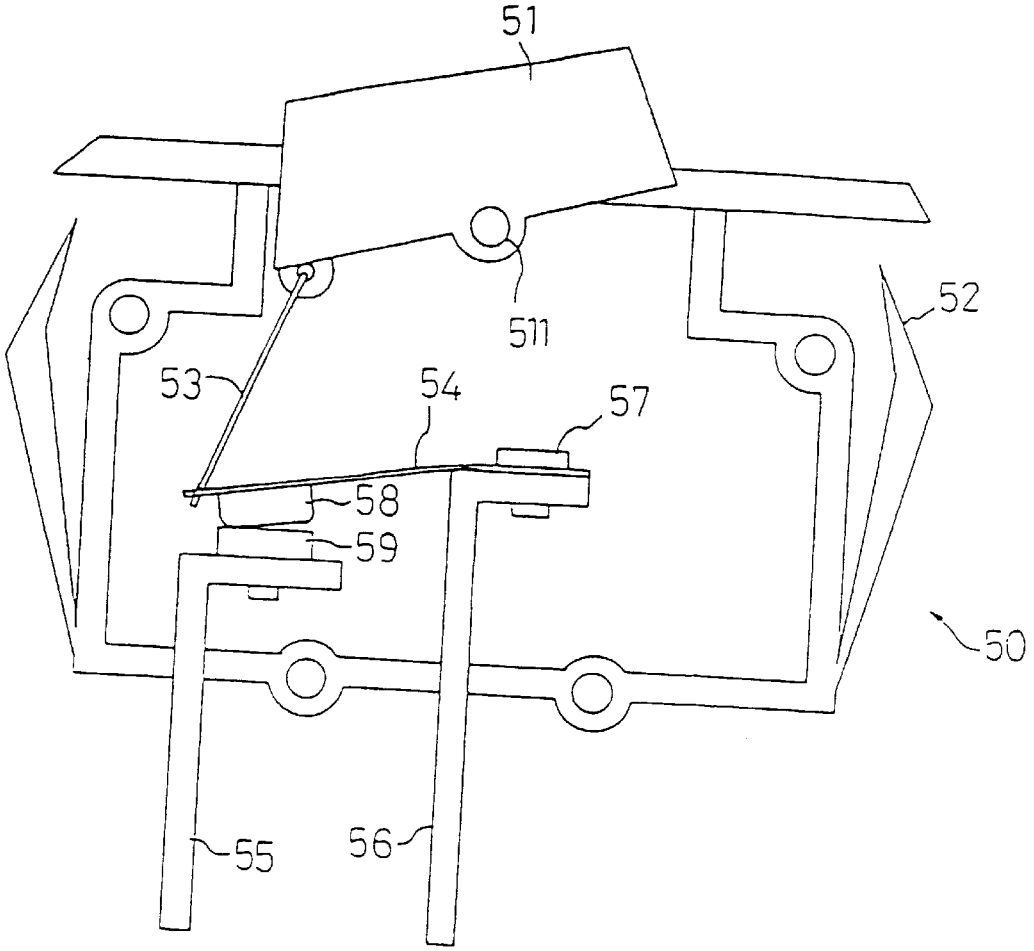
FIG. 5*b* is a side view showing the structure of a small-sized simple switch for circuit protection of the present invention in the "ON" condition.
Figure 5C:
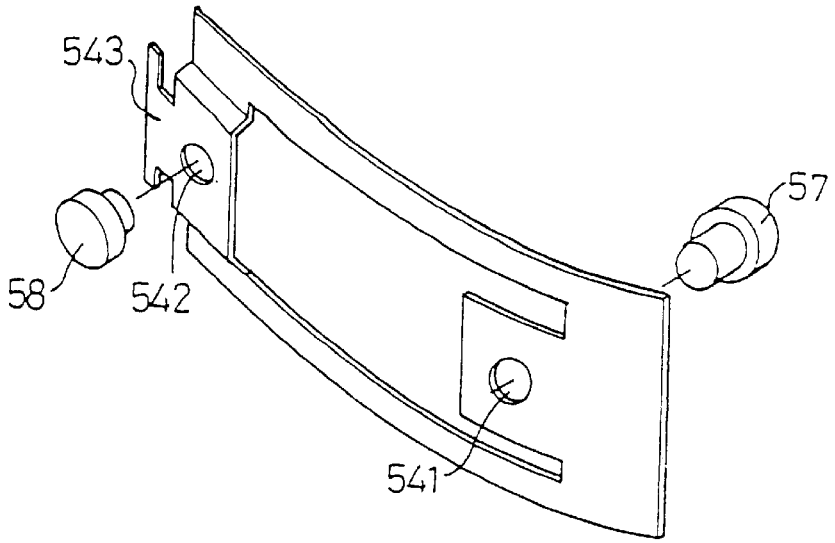
FIG. 5*c* is a side view showing the structure of the alloy plate used in the small-sized simple switch for circuit protection of the present invention.
Figure 5D:
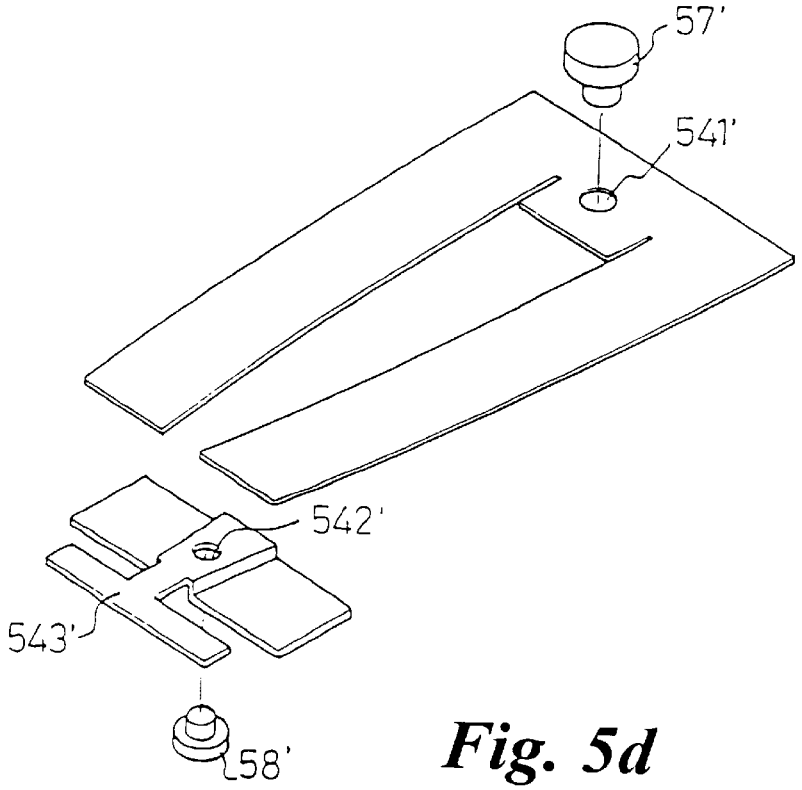
FIG. 5*d* is a side view showing the structure of the alloy plate of another configuration used in the small-sized simple switch for circuit protection of the present invention.

Referring to FIGS. 5*a* and 5*b*, which are side views showing the structure of a small-sized simple switch for circuit protection of the present invention in the "OFF" and "ON" conditions, respectively. The small-sized simple switch for circuit protection comprises a body 50, a reset button 51 being pivotally connected to the upper portion thereof via a pivot 511 and able to swing side to side. A lever 53 is pivotally connected to the left end of the 51 such that the lever 53 can be pushed and pulled relative to each other. A pair of detent portions 52 disposed on two sides of the body 50 are advantageous for the switch to be fixed into any electrical appliance. A pair of wire connecting pad 55, 56 are embedded in the lower face of the body 50 wherein the first wire connecting pad 55 is provided with a silver contacting point 59 and one end of the alloy plate 54 is secured to the second wire connecting pad 56 by means of a rivet 57. The alloy plate 54 is a hollow rectangular structure and the portion secured to the second wire connecting pad is projected into the hollow portion (as shown in FIG. 5*c*), the other end of the alloy plate 54 is provided with a through hole 542 which is combined with a rivet to form a silver contacting point 58. It can be seen from FIG. 5*a* that the switch is in the "OFF" condition wherein the reset button 51 is depressed to the right such that the lever 53 is pulled up, causing the silver contacting points 58, 59 to be out of contact, thus bringing the switch into the "OFF" condition. The alloy plate 54 is highly resilient because of its approximately rectangular and hollow structure as shown in FIG. 5*c* and it is hooked and connected by the lever 53 through a projection 543. When depressing on the reset button 51 to the left, the switch is turned on, causing the connected circuit to be in the "ON" condition and the switch is in the condition as shown in FIG. 5*b* wherein the lever 53 pushes the alloy plate 54 down, causing the alloy plate 54 to become bent down and bringing the silver contacting point 58 into contact with the silver contacting point 59 on the first wire connecting pad 55 such that the switch is turned on. The alloy plate 54 consists of different alloy materials with different thermal expansion coefficients such that the alloy plate becomes deformed upward due to thermal expansion during the power overload, causing the silver contacting points 58, 59 which are originally in contact with each other to become disengaged, thus causing the switch to be turned "OFF" to achieve the safety protection of the circuit. Then, the alloy plate bends up and deforms due to expansion and pushes the lever 53 such that the reset button 51 changes from the originally left depressed condition to the right depressed condition. The switch can be reset to the turned on condition again only by the user depressing the reset button 51 to the left once more. FIG. 5*d* shows another configuration of the alloy plate of the present invention wherein the alloy plate is also of a hollow configuration which is different from that shown in FIG. 5*c* in that the originally disengaged members 54*a* and 54*b* are bonded by welding, and the member 54*a* still has a projection portion 543' for connecting the lever 53, a through hole 542', and a silver contacting point 58' for contacting the silver contacting point 59 on the first wire connecting pad 55. In addition, the member 54*b* is also provided with a through hole 541' for fixing to the second wire connecting pad 56 by a rivet 57'. In this configuration, an alloy plate which consists of two members bonded together is used instead of the integrally formed alloy plate, which saves material consumption and thus reduces the manufacturing cost.

Figure 6:
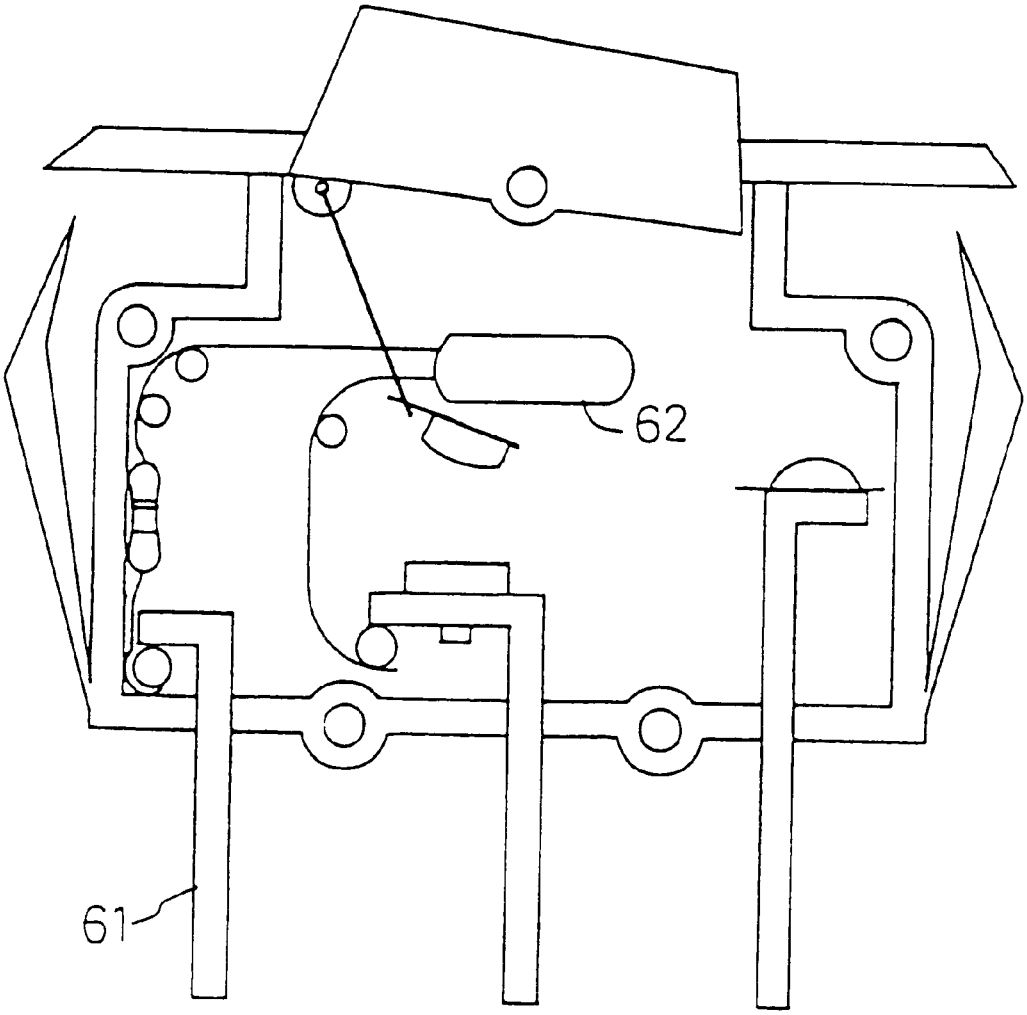
FIG. 6 is a side view showing another embodiment of the small-sized simple switch for circuit protection of the present invention.

FIG. 6 shows another embodiment of the present invention wherein a third wire connecting pad 61 is embedded into the lower portion of the body 50 and is connected to a neon lamp 62 by a lead and to the second wire connecting pad, such that when the switch is turned on, the neon lamp is lighten to indicate that the switch is in the "ON" operating condition.

The foregoing illustrates only what are the preferred configurations of the present invention without limiting the scope thereof. It is intended that all the modifications and changes not departing from the spirit of the present invention are considered as equivalent implementation of the present invention and should be covered in the scope as defined in the appended claims.

What is claimed is:

1. A small-sized simple switch for circuit protection comprises a body; a pressing portion being pivotally connected to the upper portion of said body; at least two wire connecting pads being embedded in the lower face of said body, wherein a first wire connecting pad is provided with a silver contacting point; and a lever with an upper end pivoted to one end of the pressing portion to be pushed or pulled in cooperation with the pressing portion; wherein a second wire connecting pad has an upper portion secured to an alloy plate, the other end of the alloy plate being pivoted to the lever and having a silver contacting point; wherein the alloy plate is highly resilient; and that in normal temperature, by depressing the pressing portion, the alloy plate becomes resiliently bent, causing the silver contacting point to be in or out of contact with the first wire connecting pad and the switch is turned on or off through pushing or pulling the lever, and during overload, the alloy plate expands and becomes deformed only due to its own intrinsic resilient forces, causing the lever to be pushed up and the pressing portion to move to its original position, and the silver contacting point on the first wire connecting pad and the silver contacting point on the alloy plate which are in contact with each other to become disengaged, rendering the switch to be in off condition for circuit protection.

2. A small-sized simple switch according to claim 1 further comprising a third wire connecting pad connected to a neon lamp by a lead and to the second wire connecting pad, such that when the switch is turned on, the neon lamp is lighten to indicate that the switch is in the "ON" operating condition.

3. The small-sized simple switch according to claim 1 wherein the body is provided externally with a detent portion for fixing purpose when the switch is assembled.

* * * * *